US011578728B2

(12) United States Patent
Tsai et al.

(10) Patent No.: US 11,578,728 B2
(45) Date of Patent: Feb. 14, 2023

(54) FAN MODULE

(71) Applicants: Han-Hsuan Tsai, Taipei (TW); Jui-Min Huang, Taipei (TW); Wei-Hao Lan, Taipei (TW); Chien-Chu Chen, Taipei (TW); Ching-Ya Tu, Taipei (TW); Chih-Wen Chiang, Taipei (TW); Ching-Tai Chang, Taipei (TW); Ken-Ping Lin, Taipei (TW); Yao-Lin Chang, Taipei (TW); Cheng-Ya Chi, Taipei (TW)

(72) Inventors: Han-Hsuan Tsai, Taipei (TW); Jui-Min Huang, Taipei (TW); Wei-Hao Lan, Taipei (TW); Chien-Chu Chen, Taipei (TW); Ching-Ya Tu, Taipei (TW); Chih-Wen Chiang, Taipei (TW); Ching-Tai Chang, Taipei (TW); Ken-Ping Lin, Taipei (TW); Yao-Lin Chang, Taipei (TW); Cheng-Ya Chi, Taipei (TW)

(73) Assignee: COMPAL ELECTRONICS, INC., Taipei (TW)

( * ) Notice: Subject to any disclaimer, the term of this patent is extended or adjusted under 35 U.S.C. 154(b) by 151 days.

(21) Appl. No.: 16/831,815

(22) Filed: Mar. 27, 2020

(65) Prior Publication Data

US 2020/0355199 A1 Nov. 12, 2020

Related U.S. Application Data

(60) Provisional application No. 62/825,004, filed on Mar. 27, 2019.

(51) Int. Cl.
*F04D 29/28* (2006.01)
*F04D 29/02* (2006.01)
(Continued)

(52) U.S. Cl.
CPC ..... *F04D 29/287* (2013.01); *F04D 17/08* (2013.01); *F04D 27/002* (2013.01);
(Continued)

(58) Field of Classification Search
None
See application file for complete search history.

(56) References Cited

U.S. PATENT DOCUMENTS 9,328,713 B2 * 5/2016 Beaston ..... F03B 3/14
2011/0027084 A1 2/2011 Rekret
(Continued)

OTHER PUBLICATIONS

"Office Action of Taiwan Counterpart Application", dated Feb. 2, 2021, p. 1-p. 5.

*Primary Examiner* — Juan G Flores
(74) *Attorney, Agent, or Firm* — JCIPRNET

(57) ABSTRACT

A fan module including a body and a plurality of blades is provided. The body has a rotating axis and the body is telescopic along the rotating axis to have an elongated state and a shortened state. The blades are respectively disposed on the body and rotate along with the body along the rotating axis. At least a portion of each blade is flexible and a bending state of each blade is changed along with the elongated state or the shortened state of the body. An axial size of each blade along the rotating axis when the body is in the elongated state is greater than the axial size of each blade along the rotating axis when the body is in the shortened state.

20 Claims, 7 Drawing Sheets

(51) Int. Cl.
*F04D 29/30* (2006.01)
*F04D 27/00* (2006.01)
*F04D 17/08* (2006.01)

(52) U.S. Cl.
CPC ..... *F04D 29/023* (2013.01); *F04D 29/281* (2013.01); *F04D 29/305* (2013.01)

(56) References Cited

U.S. PATENT DOCUMENTS

2014/0193242 A1* 7/2014 Kuo ..... F04D 29/282
415/129
2017/0241430 A1* 8/2017 Huang ..... F04D 29/30

* cited by examiner

FAN MODULE

CROSS-REFERENCE TO RELATED APPLICATION

This application claims the priority benefit of U.S. provisional application Ser. No. 62/825,004, filed on Mar. 27, 2019. The entirety of the above-mentioned patent application is hereby incorporated by reference herein and made a part of this specification.

BACKGROUND

Technical Field

The disclosure relates to a fan module.

Description of Related Art

In response to the thinning trend of consumer electronic products, electronic products such as computers and handheld devices are all developing toward the direction of being light and thin and having high efficiency, but being light and thin often contradicts with having high efficiency. When a high-efficiency element is operating, a large amount of waste heat is generated inside the electronic product. Therefore, a heat dissipation module needs to be disposed to perform heat dissipation and cooling down of the element. However, due to the limitation of size thinning of electronic products, it is difficult for heat dissipation efficiency of conventional heat dissipation modules to meet the demand.

Taking an electronic product disposed with a heat dissipation fan as an example, the size of the cooling fan usually needs to be adaptively adjusted and even reduced along with the product body. However, in the case of an electronic element with higher heat radiation, the above measure obviously cannot meet the heat dissipation requirement, and vice versa.

As such, heat dissipation fans with adjustable thickness have been developed today, which combine two sets of motors and two sets of fan blades in response to the requirements of electronic products operating at different high-power consumptions. However, conventional heat dissipation fans still have matching issue with rotating speed and the fan blades are prone to resonance and noise whether during acceleration or deceleration. At the same time, since two sets of motors and fan blades are combined, there are also issues with complicated structure and large power consumption.

SUMMARY

The disclosure provides a fan module, which has changeable blade size and chamber size to meet different heat dissipation requirements.

The fan module of the disclosure includes a body and a plurality of blades. The body has a rotating axis and is telescopic along the rotating axis to have an elongated state and a shortened state. The blades are respectively disposed on the body and rotate along with the body along the rotating axis. At least a portion of each blade is flexible and a bending state of each blade is changed along with the elongated state or the shortened state of the body. An axial size of each blade along the rotating axis when the body is in the elongated state is greater than the axial size of each blade along the rotating axis when the body is in the shortened state.

In an embodiment of the disclosure, the body includes a first hub, a first disc, a second hub, and a second disc. The first disc is disposed on the first hub. The first hub and the second hub are movably sleeved together along the rotating axis. The second disc is disposed on the second hub. Each blade has a plurality of regions connected to each other in sequence along an axial direction of the rotating axis. A first position and a last position of the regions are respectively connected to the first disc and the second disc.

In an embodiment of the disclosure, the regions are divided into a first type and a second type, the region belonging to the second type is flexible, and the region belonging to the first type is adjacent and connected to the region belonging to the second type.

In an embodiment of the disclosure, a toughness of the region belonging to the second type is greater than a toughness of the region belonging to the first type, and the region belonging to the second type maintains a gap relative to the first hub and the second hub.

In an embodiment of the disclosure, the region belonging to the first type and located in the first position or the last position is connected to the first hub or the second hub.

In an embodiment of the disclosure, the first hub or the second hub also has a connecting layer to connect to the region belonging to the second type. The connecting layer is flexible and a toughness of the connecting layer is consistent with the toughness of the region belonging to the second type.

In an embodiment of the disclosure, an area of the region belonging to the first type is greater than an area of the region belonging to the second type.

In an embodiment of the disclosure, the area of the region belonging to the first type is equal to the area of the region belonging to the second type.

In an embodiment of the disclosure, the area of the region belonging to the first type is smaller than the area of the region belonging to the second type.

In an embodiment of the disclosure, one of the first hub and the second hub has a guiding post and the other one of the first hub and the second hub has a guiding groove. The guiding post is coupled to the guiding groove, so that the first hub and the second hub move relative to each other along the rotating axis.

In an embodiment of the disclosure, the guiding groove is parallel to the rotating axis.

In an embodiment of the disclosure, the guiding groove is inclined relative to the rotating axis.

In an embodiment of the disclosure, an included angle of the guiding groove relative to the rotating axis is consistent with a relative rotation angle of the first hub and the second hub in the shortened state or the elongated state based on the rotating axis.

In an embodiment of the disclosure, at a junction of two adjacent regions, one of the regions has at least one protruding rib, the other one of the regions has at least one opening groove, the protruding rib is rotatably buckled to the opening groove, and there is a bend at the junction between the two adjacent regions.

In an embodiment of the disclosure, a bending amount of the junction between the two adjacent regions is greater than a deformation amount of the region belonging to the second type.

In an embodiment of the disclosure, each blade includes a flexible material connected between the first disc and the second disc, and a rigid material covered by the flexible material, so that there is a bend at a region of the rigid material not covered by the flexible material relative to a region of the rigid material covered by the flexible material.

In an embodiment of the disclosure, the fan module further includes at least one power source, connected to the rotating axis and configured to drive the body and the blades to rotate or the body to elongate and shorten.

In an embodiment of the disclosure, each blade is entirely made of a single flexible material.

In an embodiment of the disclosure, each blade is divided into different regions by at least one fold line.

In an embodiment of the disclosure, an orthographic projection area of each blade on a plane when the body is in the elongated state is greater than the orthographic projection area of each blade on the plane when the body is in the shortened state, wherein the rotating axis is located on the plane.

Based on the above, since the body of the fan module has a telescopic state change along the rotating axis while a portion of the blades is also flexible, the axial size of the blades along the rotating axis will be expanded or reduced along with the telescopic state of the body. In other words, the user may adjust the elongated state or the shortened state of the body according to the heat dissipation requirements, so as to change the size of the fan chamber while controlling the wind catching area of the blades, thereby controlling the wind amount of the fan module. Accordingly, the fan module is no longer limited by the body space of the electronic product, so as to improve the applicability thereof.

DETAILED DESCRIPTION OF DISCLOSED EMBODIMENTS

Figure 1A:
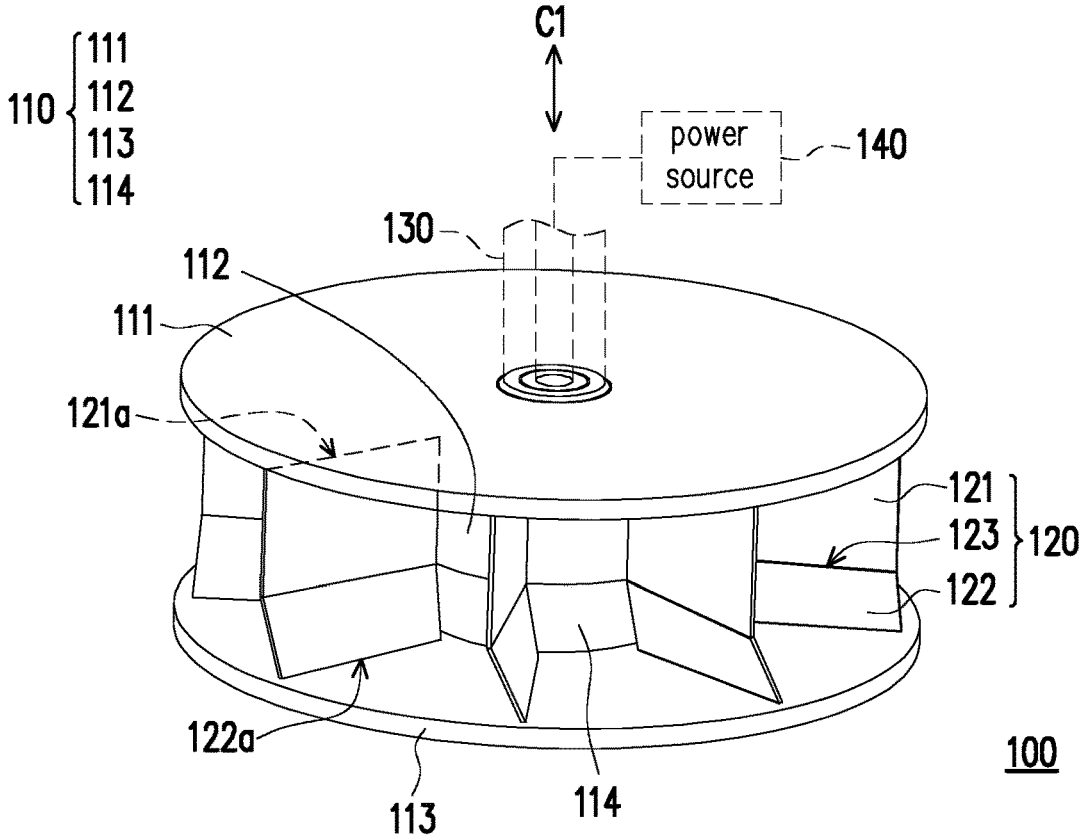
FIG. 1A is a schematic diagram of a fan module according to an embodiment of the disclosure.
Figure 1B:
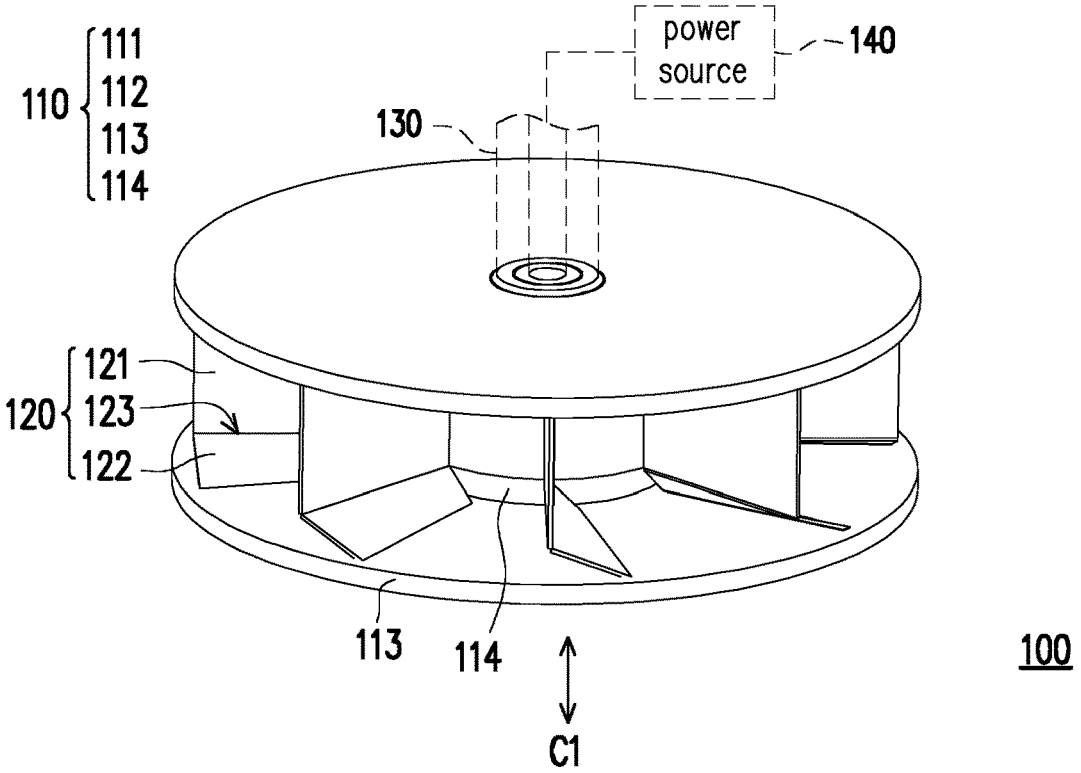
FIG. 1B is a schematic diagram of the fan module of FIG. 1A in another state.

FIG. 1A is a schematic diagram of a fan module according to an embodiment of the disclosure. FIG. 1B is a schematic diagram of the fan module of FIG. 1A in another state. Please refer to FIG. 1A and FIG. 1B at the same time. In the embodiment, a fan module 100 includes a body 110, a plurality of blades 120, a driving member 130, and a power source 140. The body 110 has a rotating axis C1 and is telescopic along the rotating axis C1. The blades 120 are respectively disposed on the body 110 and rotate along with the body 110 along the rotating axis C1. At least a portion of each blade 120 is flexible and a bending state of each blade 120 is changed along with the telescopic state of the body 110. The power source 140 is, for example, a motor, which is connected to the rotating axis C1 through the driving member 130, so as to drive the body 110 and the blades 120 to rotate, and may also be configured to drive the body 110 to elongate and shorten.

Further, the body 110 of the embodiment includes a first hub 112, a first disc 111, a second hub 114, and a second disc 113. The first disc 111 is disposed on the first hub 112. The first hub 112 and the second hub 114 are movably sleeved together along the rotating axis C1. The second disc 113 is disposed on the second hub 114. Each blade 120 has a plurality of regions 121 and 122 connected to each other in sequence along an axial direction of the rotating axis C1, wherein the region 121 is connected to the first disc 111 with a side edge 121*a* thereof and the region 122 is connected to the second disc 113 with a side edge 122*a* thereof. Furthermore, the region 122 of the blade 120 is flexible (the region 121 is not flexible), so the region 121 is regarded as the first type and the region 122 is regarded as the second type, and are adjacent and connected to each other.

Figure 2A:
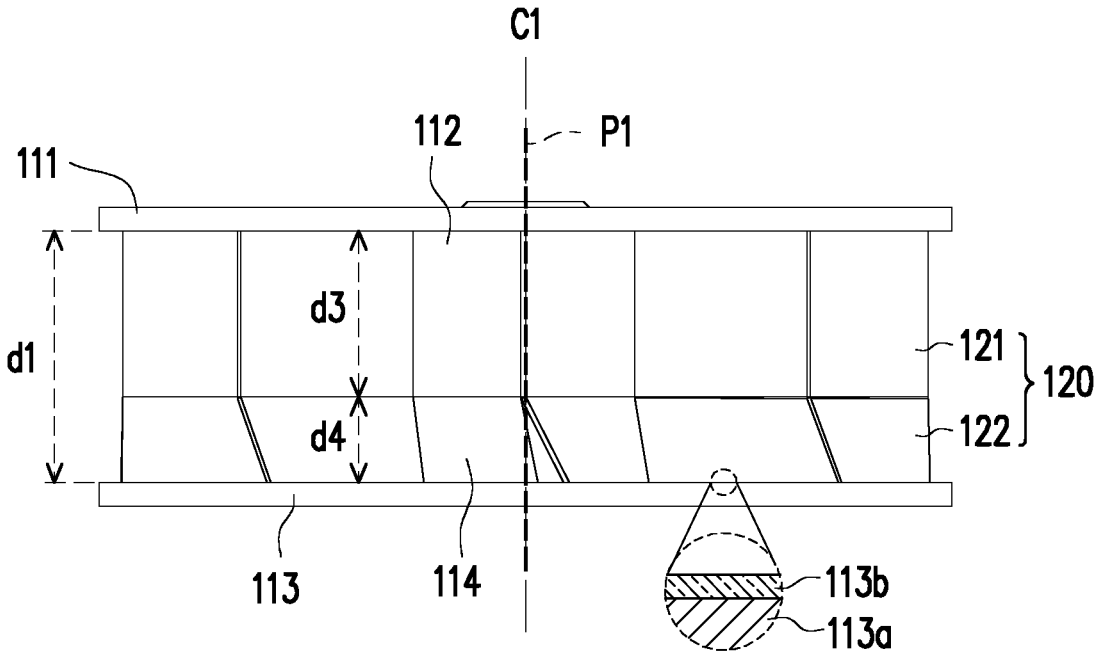
FIG. 2A is a side view of the fan module of FIG. 1A.
Figure 2B:
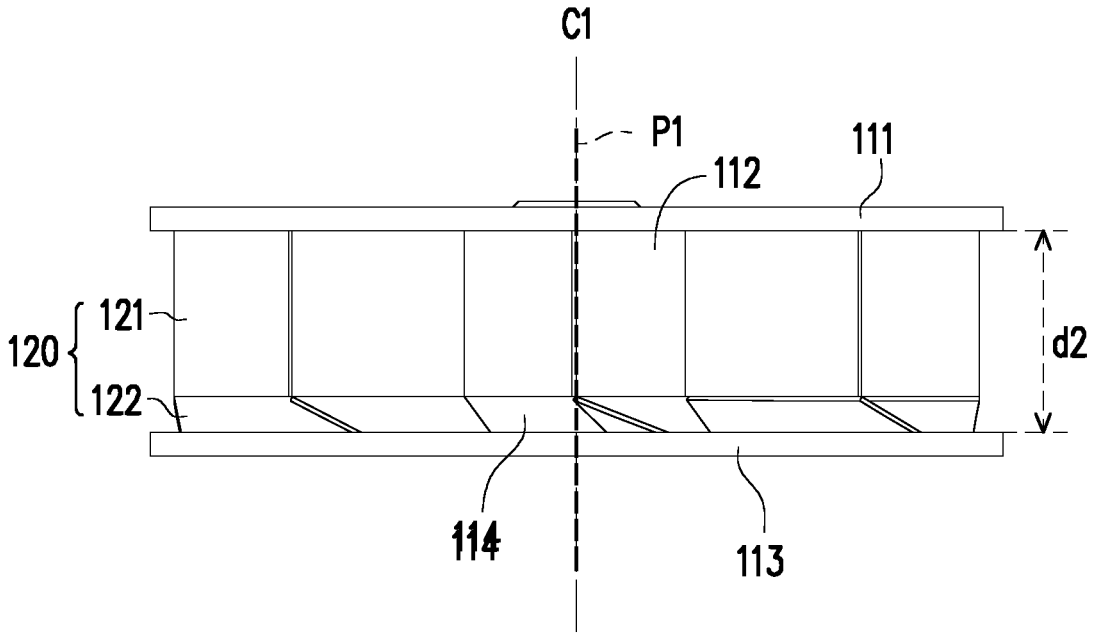
FIG. 2B is a side view of the fan module of FIG. 1B.

Accordingly, as the first hub 112 (and the first disc 111) moves relative to the second hub 114 (and the second disc 113) along the rotating axis C1, the flexible region 122 changes the degree of deformation (bending) thereof accordingly. FIG. 2A is a side view of the fan module of FIG. 1A. FIG. 2B is a side view of the fan module of FIG. 1B. Please refer to FIG. 1A and FIG. 2A first. The body 110 of the fan module 100 shown is in an elongated state. At this time, the relative distance between the first disc 111 and the second disc 113 is also equivalent to an axial size d1 of the blade 120 along the rotating axis C1. Please then refer to FIG. 1B and FIG. 2B. The body 110 of the fan module 100 shown is in a shortened state. At this time, the relative distance between the first disc 111 and the second disc 113 is also equivalent to an axial size d2 of the blade 120 along the rotating axis C1, wherein the axial size d1 is greater than the axial size d2. In other words, an orthographic projection area of the blade 120 on a plane P1 when the body 110 is in the elongated state is greater than the orthographic projection area of the blade 120 on the plane P1 when the body 110 is in the shortened state, wherein the rotating axis C1 is located on the plane P1.

As such, it can be seen that as the first hub 112 (and the first disc 111) moves away from the second hub 114 (and the second disc 113), the blade 120 is elongated accordingly, thereby increasing the amount of airflow entering the fan module 100, that is, the wind catching amount of the blade 120 may also be increased. Also, it can be regarded as that during the telescopic processes of the body 110, the space between the first disc 111 and the second disc 113, that is, the space (regarded as a fan chamber) for driving and compressing the airflow entering the fan module 100, is also expanded or reduced.

Figure 3:
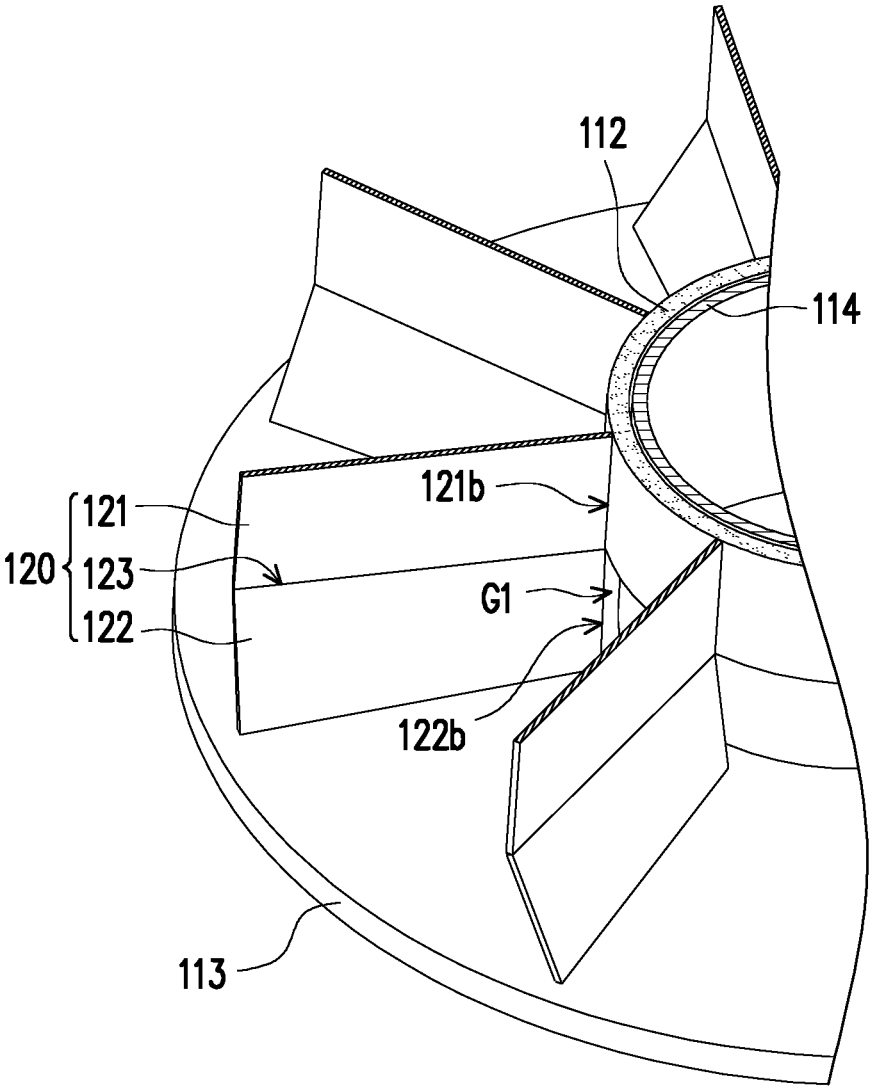
FIG. 3 is a schematic diagram of a portion of the fan module of FIG. 1A.

Since the region 122 is flexible, the fan module 100 of the embodiment needs to further adjust the relevant structural configuration. FIG. 3 is a schematic diagram of a portion of the fan module of FIG. 1A. Please refer to FIG. 3. In the embodiment, the toughness of the region 122 belonging to the second type is greater than the toughness of the region 121 belonging to the first type. The side edge 122*b* of the region 122 belonging to the second type maintains a gap G1 relative to the first hub 112 and the second hub 114, so that the blade 120 may smoothly deform at the region 122. In contrast, the region 121 may be regarded as a rigid structure without deformation to drive the region 122, so the side edge 121*b* of the region 121 is directly connected to the first hub 112. Accordingly, the blade 120 may form a bend 123 between the regions 121 and 122, that is, the fold line shown in the drawing.

In addition, please refer to FIG. 2A again. In the embodiment, the second disc 113 includes a rigid body 113*a* and a connecting layer 113*b*, wherein the connecting layer 133*b* and the region 122 of the blade 120 are made of substantially the same material and have the same flexibility and toughness as each other, which is equivalent to enabling the connecting layer 133*b* and the region 122 to be made together by secondary injection molding using a soft material. In addition to simplifying the manufacturing process, the connecting layer 133*b* may also act as a buffer between the region 122 and the rigid body 133*a* due to the flexibility thereof, so as to offset or absorb the deformation amount of the blade 120, which is also conducive to assembly.

Please refer to FIG. 2A and FIG. 2B again. In the embodiment, the region 121 of the blade 120 has an axial size d3 along the rotating axis C1 and the region 122 has an axial size d4 along the rotating axis C1, wherein the axial size d3 is greater than the axial size d4, that is, the area of the region 121 belonging to the first type is greater than the area of the region 122 belonging to the second type. However, the disclosure is not limited thereto. In another embodiment not shown, the area of the region belonging to the first type is equal to the area of the region belonging to the second type, or the area of the region belonging to the first type is smaller than the area of the region belonging to the second type.

Figure 4A:
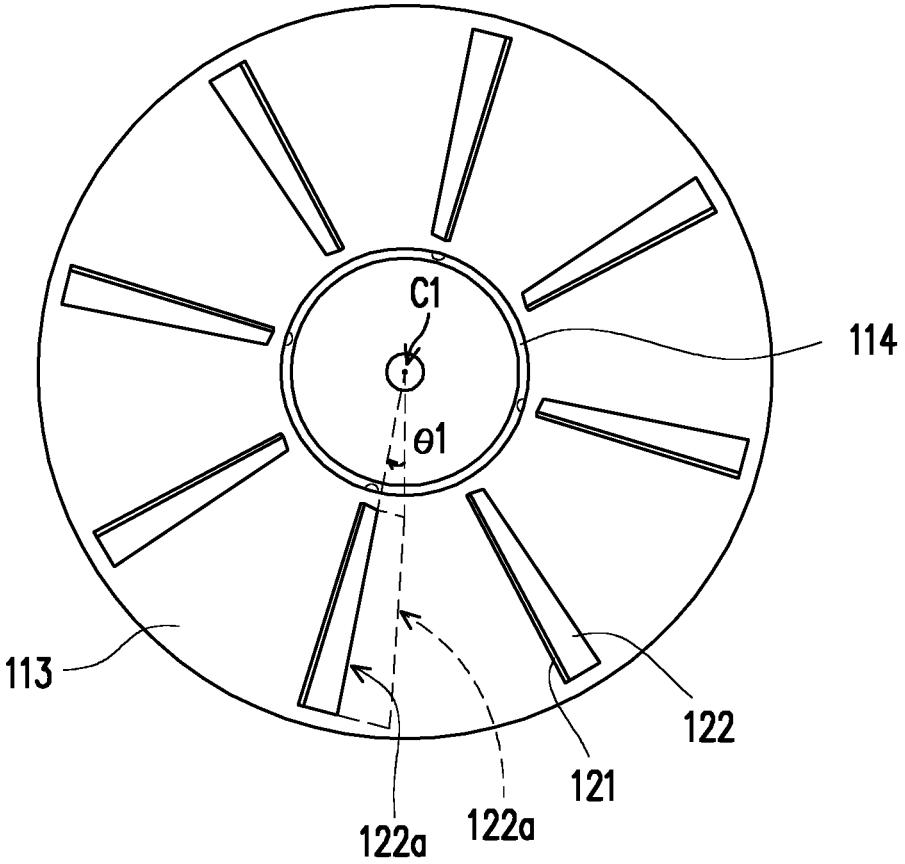
FIG. 4A illustrates a portion of the fan module of FIG. 1A from a top view perspective.
Figure 4B:
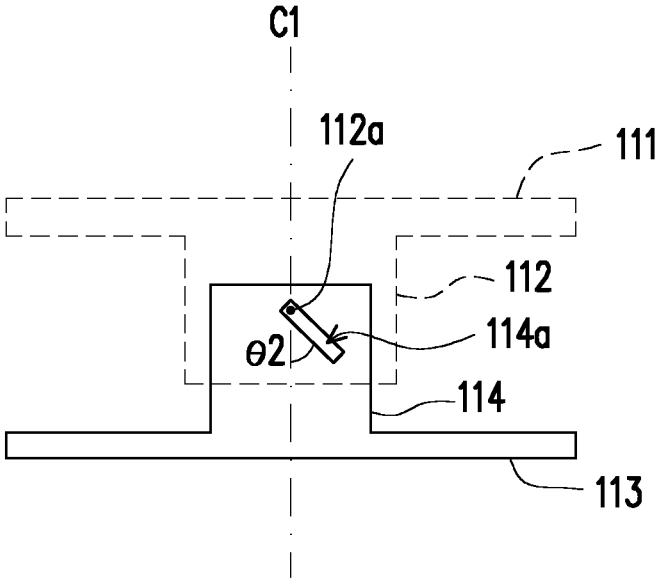
FIG. 4B illustrates a simple side view of the fan module of FIG. 4A.

FIG. 4A illustrates a portion of the fan module of FIG. 1A from a top view perspective. FIG. 4B illustrates a simple side view of the fan module of FIG. 4A. Please refer to FIG. 4A and FIG. 4B at the same time. It should be mentioned that the first hub 112 and the first disc 111 are omitted in FIG. 4A to clearly identify the state change of the blade 120. In the embodiment, in order for the body 110 to smoothly elongate and shorten, the first hub 112 of the embodiment also has a guiding post 112*a* and the second hub 114 also has a guiding groove 114*a*, wherein the guiding post 112*a* is coupled to the guiding groove 114*a*, so that the first hub 112 and the second hub 114 move relative to each other along the rotating axis C1 while rotating relative to each other. Here, the guiding groove 114*a* is inclined relative to the rotating axis C1 and has an inclination angle θ2, so that when the guiding post 112*a* and the guiding groove 114*a* move relatively away from each other, the first hub 112 (and first disc 111) and the second hub 114 (and the second disc 113) also have a rotation angle θ1 during the process of moving away from each other, wherein the side edge 122*a* of the blade 120 is shown by dotted lines to represent the corresponding position of the blade 120 when the body 110 is in the shortened state. Here, the target having the rotation angle is not limited, the target may be only the first hub 112 and the first disc 111 or only the second hub 114 and the second disc 113. Alternatively, the first hub 112 (and the first disc 111) and the second hub 114 (and the second disc 113) may have rotation angles at the same time, and the sum of the angles is θ1.

It should be noted that the configurations of the guiding post 112*a* and the guiding groove 114*a* are not limited, which may also be interchangeably disposed on the second hub 114 and the first hub 112. In addition, in another embodiment not shown, the guiding groove may be parallel to the rotating axis, so that the first hub 112 (and the first disc 111) and the second hub 114 (and the second disc 113) only move away from or close to each other along the rotating axis C1 without having any rotation angle.

Figure 5:
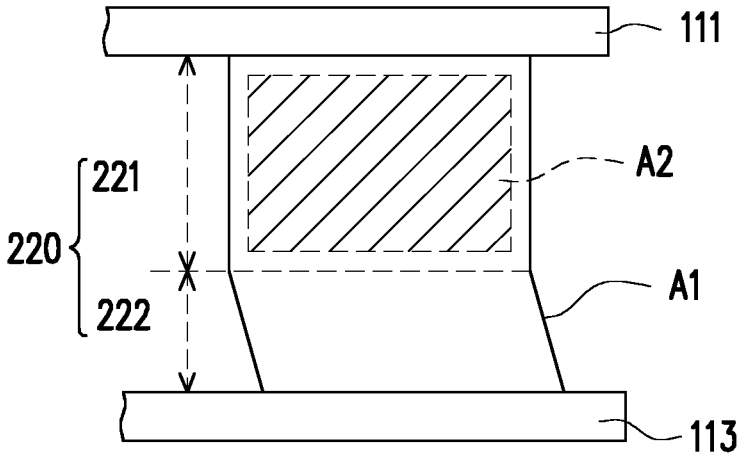
FIG. 5 is a side view of a portion of a fan module according to another embodiment of the disclosure.

FIG. 5 is a side view of a portion of a fan module according to another embodiment of the disclosure. Please refer to FIG. 5. Unlike the foregoing embodiment, a blade 220 includes a flexible material A1 connected between the first disc 111 and the second disc 113, and a rigid material A2 covered by the flexible material A1, so that there is a bend at a region 222 of the rigid material A2 not covered by the flexible material A1 relative to a region 221 of the rigid material A2 covered by the flexible material A1, which may also achieve the same effect as the foregoing embodiment.

Figure 6A:
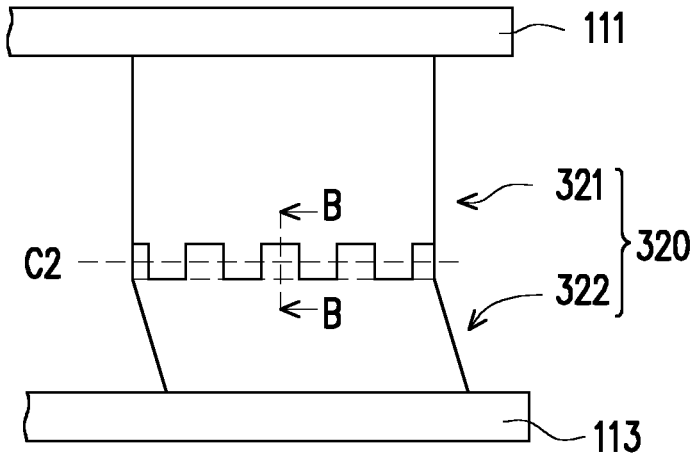
FIG. 6A is a side view of a portion of a fan module according to another embodiment of the disclosure.
Figure 6B:
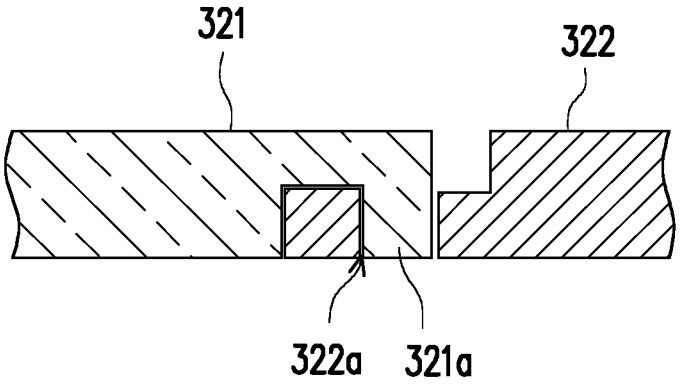
FIG. 6B is a cross-sectional view of the portion of the fan module of FIG. 6A along a cross-section B-B.

FIG. 6A is a side view of a portion of a fan module according to another embodiment of the disclosure. FIG. 6B is a cross-sectional view of the portion of the fan module of FIG. 6A along a cross-section B-B. Please refer to FIG. 6A and FIG. 6B at the same time. In the embodiment, a blade 320 includes a region 321 and a region 322, wherein the region 322 is flexible as in the foregoing embodiment. The difference is that at a junction of the two regions 321 and 322, the region 321 has a protruding rib 321*a*, the region 322 has an opening groove 322*a*, and the protruding rib 321*a* is rotatably buckled to the opening groove 322*a* along an axial direction C2, so that there is a bend at the junction of the two regions 321 and 322. In order to ensure that the blade 320 is smoothly bent at the junction, the deformable region 322 needs to be limited, that is, the bending amount of the junction is greater than the deformation amount of the region 322. As such, it can be seen that the foregoing embodiment may also be further limited according to the present embodiment.

Figure 7:
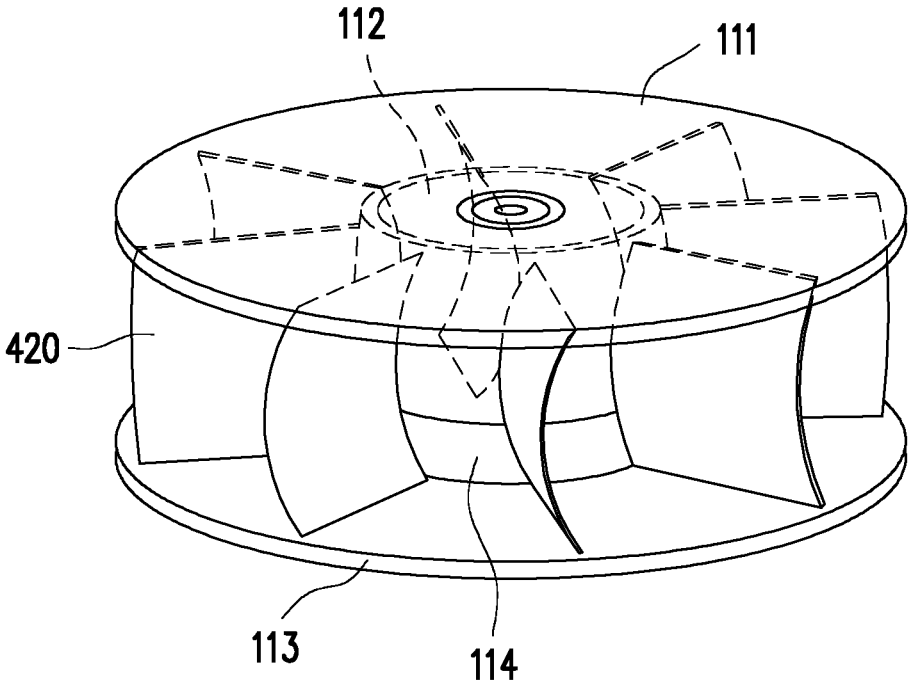
FIG. 7 and FIG. 8 are respectively schematic diagrams of fan modules according to different embodiments of the disclosure.
Figure 8:
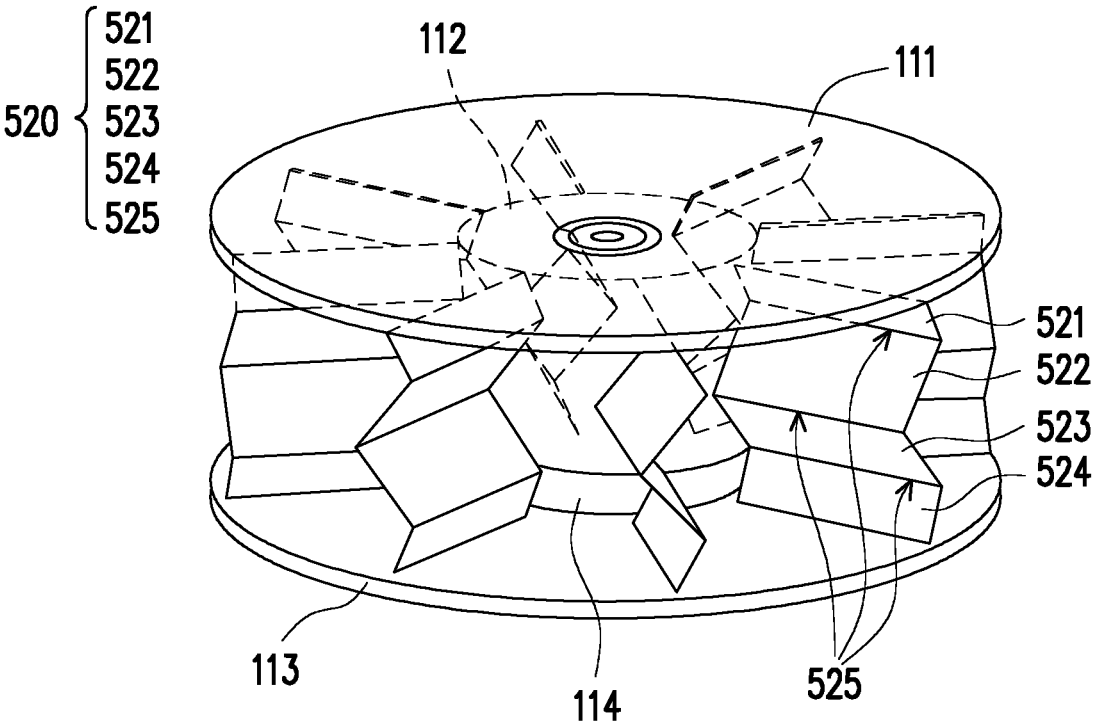

FIG. 7 and FIG. 8 are respectively schematic diagrams of fan modules according to different embodiments of the disclosure. Please refer to FIG. 7 first. In the embodiment, a blade 420 is entirely made of a single flexible material to form a crease-free blade surface. Please then refer to FIG. 8. A blade 520 includes a plurality of regions 521, 522, 523, and 524, which are sequentially arranged between the first disc 111 and the second disc 113, and adjacent regions are separated by a fold line 525, wherein the region 521 at the first position and the region 524 at the last position are respectively connected to the first disc 111 and the second disc 113. It should also be noted that whether the regions 521 to 524 are flexible is not limited here, which may be appropriately adjusted according to requirements. The only constant is that if the regions belong to the second type (flexible), the regions need to maintain a gap (such as the gap G1) with the first hub 112 and the second hub 114, and if the regions belong to the first type (rigid), the regions only need to be connected to the first hub 112 and the second hub 114 at the first position (for example, the region 521) or the last position (for example, the region 524).

In summary, in the embodiments of the disclosure, since the body of the fan module has a telescopic state change along the rotating axis while a portion of the blades is also flexible, the axial size of the blades along the rotating axis will be expanded or reduced due to the telescopic change of the body. Furthermore, the blade may be divided into at least two regions, which are arranged between the first disc and the second disc, wherein the region located at the first position or the last position is connected to the first disc and the second disc. Also, whether the regions are flexible may be appropriately adjusted according to requirements and the only constant is that the flexible regions need to maintain a gap with the first hub or the second hub, so that deformation can be smooth without any limitation.

In other words, the user may adjust the telescopic state of the body according to the heat dissipation requirements, so as to change the size of the fan chamber while controlling the wind catching area of the blades, thereby controlling the wind amount of the fan module. Accordingly, the fan module is no longer limited by the body space of the electronic product, so as to improve the applicability thereof.

What is claimed is:

1. A fan module, comprising:

a body, having a rotating axis, wherein the body is telescopic along the rotating axis to have an elongated state and a shortened state, and a size of the body in the elongated state is greater than the size of the body in the shortened state; and a plurality of blades, respectively disposed on the body, wherein the plurality of blades rotate along with the body along the rotating axis, wherein at least a portion of each of the plurality of blades is flexible and a bending state of each of the plurality of blades is changed along with the elongated state or the shortened state of the body, wherein an axial size of each of the plurality of blades along the rotating axis when the body is in the elongated state is greater than the axial size of each of the plurality of blades along the rotating axis when the body is in the shortened state.

2. The fan module according to claim 1, wherein the body comprises:

a first hub;

a first disc, disposed on the first hub;

a second hub, wherein the first hub and the second hub are movably sleeved together along the rotating axis; and a second disc, disposed on the second hub, wherein each of the plurality of blades has a plurality of regions connected to each other in sequence along an axial direction of the rotating axis, and a first position and a last position of the plurality of regions are respectively connected to the first disc and the second disc.

3. The fan module according to claim 2, wherein the plurality of regions are divided into a first type and a second type, the region belonging to the second type is flexible, and the region belonging to the first type is adjacent and connected to the region belonging to the second type.

4. The fan module according to claim 3, wherein a toughness of the region belonging to the second type is greater than a toughness of the region belonging to the first type and the region belonging to the second type maintains a gap relative to the first hub and the second hub.

5. The fan module according to claim 3, wherein the region belonging to the first type and located in the first position or the last position is connected to the first hub or the second hub.

6. The fan module according to claim 5, wherein the first hub or the second hub also has a connecting layer to connect to the region belonging to the second type, the connecting layer is flexible, and a toughness of the connecting layer is consistent with the toughness of the region belonging to the second type.

7. The fan module according to claim 3, wherein an area of the region belonging to the first type is greater than an area of the region belonging to the second type.

8. The fan module according to claim 3, wherein an area of the region belonging to the first type is equal to an area of the region belonging to the second type.

9. The fan module according to claim 3, wherein an area of the region belonging to the first type is smaller than an area of the region belonging to the second type.

10. The fan module according to claim 3, wherein one of the first hub and the second hub has a guiding post, the other one of the first hub and the second hub has a guiding groove, and the guiding post is coupled to the guiding groove, so that the first hub and the second hub move relative to each other along the rotating axis.

11. The fan module according to claim 10, wherein the guiding groove is parallel to the rotating axis.

12. The fan module according to claim 10, wherein the guiding groove is inclined relative to the rotating axis.

13. The fan module according to claim 12, wherein an included angle of the guiding groove relative to the rotating axis is consistent with a relative rotation angle of the first hub and the second hub in the shortened state or the elongated state based on the rotating axis.

14. The fan module according to claim 3, wherein at a junction of two adjacent regions, one of the regions has at least one protruding rib, the other one of the regions has at least one opening groove, the protruding rib is rotatably buckled to the opening groove, and there is a bend at the junction of the two adjacent regions.

15. The fan module according to claim 14, wherein a bending amount of the junction of the two adjacent regions is greater than a deformation amount of the region belonging to the second type.

16. The fan module according to claim 2, wherein each of the plurality of blades comprises a flexible material connected between the first disc and the second disc, and a rigid material covered by the flexible material, so that there is a bend at a region of the rigid material not covered by the flexible material relative to a region of the rigid material covered by the flexible material.

17. The fan module according to claim 1, further comprising at least one power source, connected to the rotating axis and configured to drive the body and the plurality of blades to rotate or drive the body to elongate and shorten.

18. The fan module according to claim 1, wherein each of the plurality of blades is entirely made of a single flexible material.

19. The fan module according to claim 18, wherein each of the plurality of blades is divided into different regions by at least one fold line.

20. The fan module according to claim 1, wherein an orthographic projection area of each of the plurality of blades on a plane when the body is in the elongated state is greater than the orthographic projection area of each of the plurality of blades on the plane when the body is in the shortened state, wherein the rotating axis is located on the plane.

* * * * *